US012808157B2

(12) United States Patent
Kaniche et al.

(10) Patent No.: US 12,808,157 B2
(45) Date of Patent: Nov. 24, 2026

(54) METHOD FOR ADAPTING THE OPERATOR CONTROL AND/OR ACTUATION CHARACTERISTIC OF A FRONT LOADER CONTROL SYSTEM

(71) Applicant: Deere & Company, Moline, IL (US)

(72) Inventors: Onkar Kaniche, Pune (IN); Amol Dhonde, Pune (IN)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 19/097,940

(22) Filed: Apr. 2, 2025

(65) Prior Publication Data

US 2025/0333933 A1 Oct. 30, 2025

(30) Foreign Application Priority Data

Apr. 25, 2024 (EP) ..... 24172323

(51) Int. Cl.

| | |
|---|---|
| ***E02F 9/22*** | (2006.01) |
| ***E02F 3/43*** | (2006.01) |
| ***E02F 9/26*** | (2006.01) |

(52) U.S. Cl.

CPC ..... *E02F 9/2228* (2013.01); *E02F 3/434* (2013.01); *E02F 9/262* (2013.01); *E02F 9/265* (2013.01)

(58) Field of Classification Search

None

See application file for complete search history.

(56) References Cited

U.S. PATENT DOCUMENTS

| | | | | |
|---|---|---|---|---|
| 6,064,933 | A * | 5/2000 | Rocke | E02F 3/434 172/12 |
| 6,205,687 | B1 * | 3/2001 | Rocke | E02F 3/432 701/50 |
| 7,905,089 | B2 * | 3/2011 | Ma | E02F 9/2235 60/452 |
| 7,979,181 | B2 * | 7/2011 | Clark | E02F 9/2029 701/50 |
| 2018/0135273 | A1 | 5/2018 | Tsuji | |

(Continued)

FOREIGN PATENT DOCUMENTS

EP 2843378 A1 3/2015

OTHER PUBLICATIONS

Extended European Search Report and Written Opinion issued in European Patent Application No. 24172323.8 dated Oct. 14, 2024, in 08 pages.

*Primary Examiner* — Abdhesh K Jha

(57) ABSTRACT

A method for adapting the operator control and actuation characteristic of a front loader control system that has an operator control hand lever, includes evaluating via a control unit a sensor-detected deflection at the operator control hand lever, hydraulically controlling via the control unit an actuating device in accordance with the sensor-detected deflection for raising and lowering a front loader boom having a loading tool for picking up a load material, adapting via the control unit a functional relationship between the sensor-detected deflection at the operator control hand lever and a hydraulic flow generated for the hydraulic control of the actuating device, and adapting via the control unit the functional relationship in accordance with a determined material property variable that represents a plunging resistance that opposes the loading tool when picking up the load material.

8 Claims, 2 Drawing Sheets

(56) References Cited

U.S. PATENT DOCUMENTS

| | | | |
|---|---|---|---|
| 2020/0063399 | A1 | 2/2020 | Miller |
| 2021/0115643 | A1 | 4/2021 | Tanaka et al. |
| 2023/0024622 | A1 | 1/2023 | Hoaby et al. |

* cited by examiner

METHOD FOR ADAPTING THE OPERATOR CONTROL AND/OR ACTUATION CHARACTERISTIC OF A FRONT LOADER CONTROL SYSTEM

CROSS-REFERENCE TO RELATED APPLICATIONS

This application claims priority to European Patent Application No. 24172323.8, filed Apr. 25, 2024, which is hereby incorporated by reference.

FIELD OF THE DISCLOSURE

The disclosure relates to a method for adapting the operator control and/or actuation characteristic of a front loader control system.

BACKGROUND

Front end loaders are used for transferring material using a bucket or loading fork. Hydraulic actuating devices adjust the height and inclination of the bucket or loading fork.

SUMMARY

The disclosure relates to a method for adapting the operator control and/or actuation characteristic of a front loader control system that has an operator control hand lever, a control unit (e.g., a controller including a processor and memory) for evaluating a sensor-detected deflection at the operator control hand lever, and an actuating device, which is hydraulically controllable by the control unit in accordance with the sensor-detected deflection, for raising and lowering a front loader boom having a loading tool for picking up a load material, wherein a functional relationship between the sensor-detected deflection at the operator control hand lever and a hydraulic flow generated for the hydraulic control of the actuating device is adaptable by the control unit.

Front loaders are used, inter alia, for transferring load material by means of a loading tool designed as a bucket or loading fork and located at a free end of a front loader boom. By means of hydraulically controllable actuating devices that are part of a loader linkage, the loading tool can be adjusted in terms of its height relative to the ground and in terms of its inclination, such that it is made possible for the loading tool to be plunged in targeted fashion into a stock of load material in order to pick up the load material. The front loader is attached as a removable accessory unit in the front region of an agricultural tractor, for example, but the latter may also be designed as a bucket excavator, a telescopic loader or some other corresponding loading vehicle from the construction or agricultural sector. The load material comprises materials such as straw, hay, silage, manure, cereals, maize, gravel, sand, soil, or the like.

The operator control of the front loader is generally performed by means of an operator control hand lever designed as a joystick. Here, the front loader boom can be raised and lowered in accordance with a direction of deflection of the operator control hand lever. Here, the extent of the deflection determines the hydraulic flow generated for the control of the actuating device in question. In order to allow for different material properties of the load material that is to be picked up, with a view to carrying out the loading operation efficiently, assistance systems are also known with which the operator can, via a user interface, choose between different operator control and/or actuation characteristics for the front loader control system. Each operator control and/or actuation characteristic is defined on the basis of a specified functional relationship between the sensor-detected deflection at the operator control hand lever and the hydraulic flow that is generated.

The selection of an operator control and/or actuation characteristic that is suitable for transferring the load material in question necessitates corresponding experience on the part of the operator. Therefore, depending on the type of load material, less experienced operators may carry out the load operation less efficiently owing to an incorrect selection.

In view of this situation, it is an object of the present disclosure to specify a method of the type stated at the outset such that the operator is actively assisted in efficiently carrying out a loading operation by means of a front loader.

This object is achieved by means of a method for adapting the operator control and/or actuation characteristic of a front loader control system, said method having the features of one or more embodiments disclosed herein.

In a method for adapting the operator control and/or actuation characteristic of a front loader control system, the front loader control system has an operator control hand lever, a control unit for evaluating a sensor-detected deflection at the operator control hand lever, and an actuating device, which is hydraulically controllable by the control unit in accordance with the sensor-detected deflection, for raising and lowering a front loader boom having a loading tool for picking up a load material, wherein a functional relationship between the sensor-detected deflection at the operator control hand lever and a hydraulic flow generated for the hydraulic control of the actuating device is adaptable by the control unit. Here, the functional relationship is adapted by the control unit in accordance with a determined material property variable that represents a plunging resistance that opposes the loading tool when picking up the load material.

Since the plunging resistance has a major influence on the hydraulic power that has to be expended in picking up the load material, inefficient operating states of the front loader control system can be reliably avoided through suitable adaptation or limitation of the hydraulic flow that is generated for the hydraulic control of the associated actuating device. The adaptation or limitation is performed through the selection of a functional relationship that corresponds to the current plunging resistance, and thus without any further action on the part of the operator, such that the operator is actively assisted in efficiently carrying out a loading operation by means of a front loader.

Advantageous developments of the method according to the disclosure can be found in one or more embodiments disclosed herein.

In some embodiments, on the basis of the determined material property variable, the control unit assigns the picked-up load material to a first material class characterized by soft material properties or to a second material class characterized by hard material properties, wherein the functional relationship is adapted on the basis of this assignment. The division of the load material into two or only two material classes results in correspondingly reduced computational effort on the part of the control unit, and is sufficient for most applications. For example, soft materials (for example stalk-like plant parts) such as straw, hay, silage, or manure exhibit a measurably lower plunging resistance than hard (generally spreadable or granular) materials such as cereals, maize, gravel, sand, or soil.

It is furthermore possible that the functional relationship is adapted by the control unit with regard to a linear, progressive, or mixed linear-progressive generation of the hydraulic flow. The generation of the hydraulic flow is linear or progressive if it increases proportionally or (quasi-) exponentially with the sensor-detected deflection of the operator control hand lever. Here, a linear increase of the hydraulic flow has proven to be advantageous when picking up soft materials, and a linear-progressive or progressive increase has proven to be advantageous in the case of hard materials.

It is furthermore conceivable that, for the purposes of determining the material property variable, the control unit detects an actuation moment that is exerted on the loading tool when picking up the load material. This allows reliable conclusions to be drawn regarding the plunging resistance that opposes the loading tool when picking up the load material, and may be estimated for example on the basis of the sensor-detected pressure conditions in a further hydraulically controllable actuating device that is used for tilting the loading tool on the front loader boom. On the other hand, a direct detection may also be performed by means of a strain gauge device arranged at a suitable location on a loader linkage.

Taking this as a starting point, it is possible that, for the purposes of assigning the picked-up load material to one of the two material classes, the control unit compares the detected actuation moment with a respectively assigned class-specific value range. The class-specific value range is specified empirically, for which purpose a multiplicity of goods for transfer are evaluated and correspondingly classified with regard to the actuation moments that occur in the loading tool when said goods are picked up.

Provision may additionally be made whereby, for the purposes of verifying the undertaken assignment of the picked-up load material to one of the two material classes, the control unit considers the detected actuation moment in relation to a speed variable, which reflects a plunging speed of a loading tool into the load material, and compares said detected actuation moment with a respectively associated further class-specific value range. The speed variable may be estimated, to a good approximation, from a present forward traveling speed of the loading vehicle. This makes it possible for the actuation moment that is exerted on the loading tool to be evaluated with regard to speed-dependent influences, making an additional limitation or specification possible in the assignment of the picked-up load material to one of the two material classes.

Furthermore, for the purposes of verifying the undertaken assignment of the picked-up load material to one of the two material classes, the control unit may determine the weight of the load material picked up by the loading tool, and compare said weight with a respectively associated class-specific weight range. This makes allowance for the fact that soft and hard materials generally exhibit significant differences in terms of their mass density, which can be utilized for the purposes of further limitation or specification in the assignment of the picked-up load material to one of the two material classes. The weight determination may be performed for example using a weighing device as described in detail in EP 2 843 378 A1.

The particular class-specific further value range or weight range is likewise specified here empirically by corresponding evaluation and classification of a multiplicity of goods for transfer.

The above and other features will become apparent from the following detailed description and accompanying drawings.

BRIEF DESCRIPTION OF THE DRAWINGS

The method according to the disclosure will be explained in more detail hereinafter on the basis of the appended drawings. In the drawings.

DETAILED DESCRIPTION

The embodiments or implementations disclosed in the above drawings and the following detailed description are not intended to be exhaustive or to limit the present disclosure to these embodiments or implementations.

Figure 1:
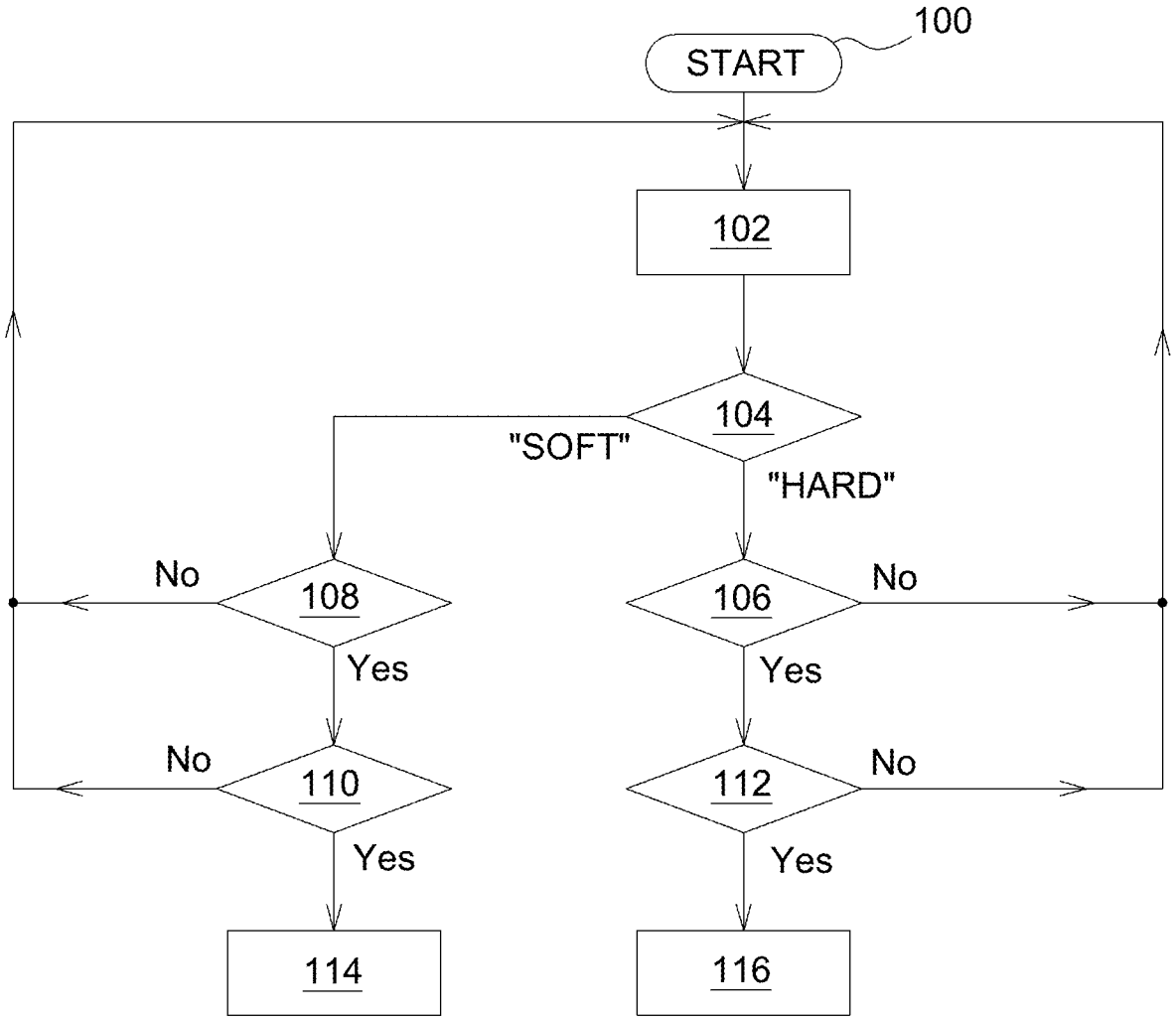
FIG. 1 shows an example embodiment, illustrated as a flow diagram, of the method according to the disclosure for adapting the operator control and/or actuation characteristic of a front loader control system.
Figure 2:
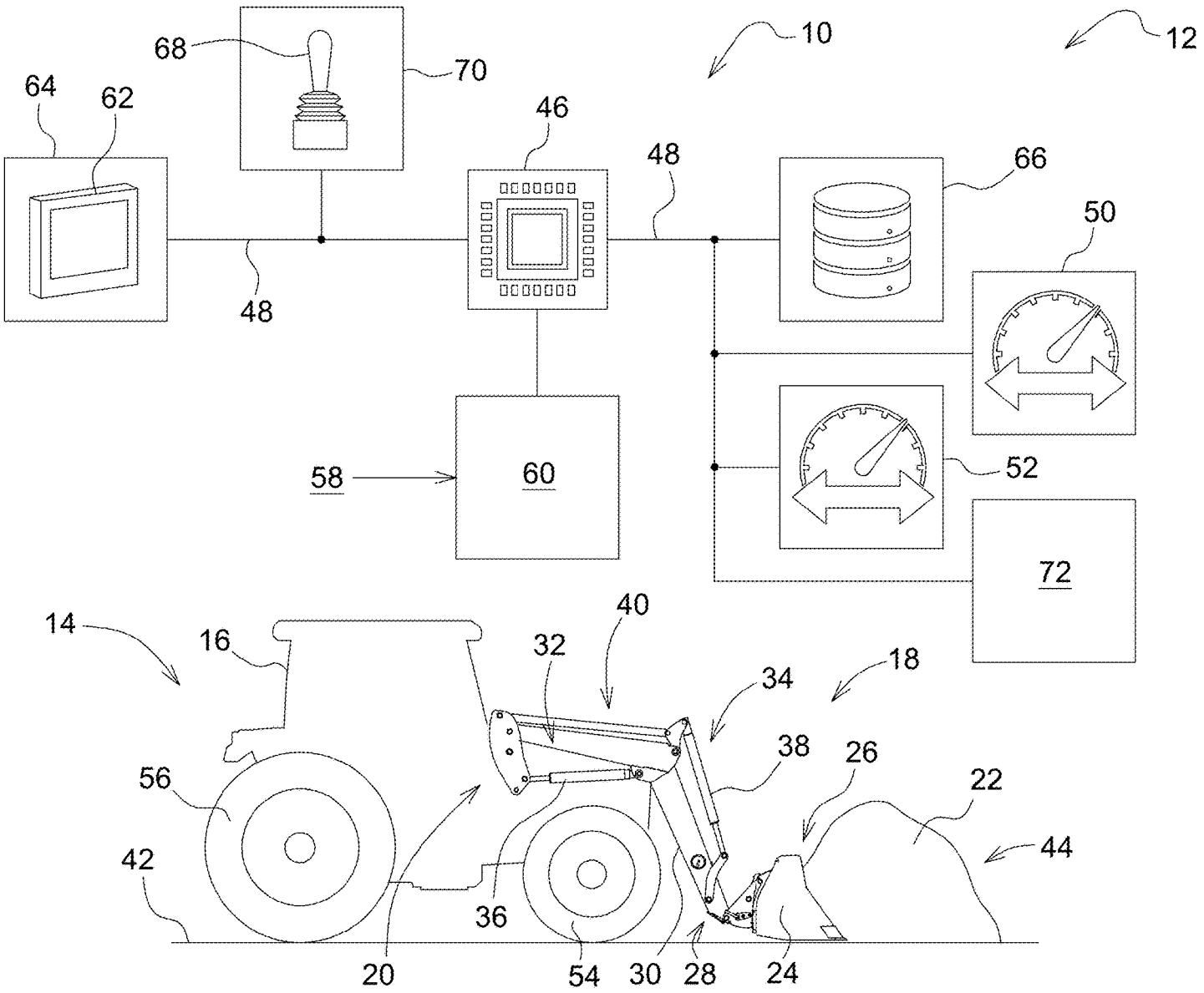
FIG. 2 shows a schematically illustrated arrangement for carrying out the method according to the disclosure for adapting the operator control and/or actuation characteristic of a front loader control system.

FIG. 1 shows an example embodiment, illustrated as a flow diagram, of the method according to the disclosure for adapting the operator control and/or actuation characteristic of a front loader control system 10, wherein this method will be described below with reference to the arrangement 12 according to FIG. 2 provided for carrying it out.

Considering FIG. 2, the arrangement 12 is part of a loading vehicle 14 in the form of an agricultural tractor 16 having a front loader 18 arranged thereon, wherein the front loader 18 is attached as a removable accessory unit in the front region 20 of the agricultural tractor 16.

More specifically, the front loader 18 is used for transferring load material 22 by means of a loading tool 26 designed in the present case as a bucket 24 (or else as a loading fork), which is located at a free end 28 of a front loader boom 30. By means of first and second hydraulically controllable actuating devices 32, 34 in the form of associated hydraulic cylinder 36, 38, which are part of a loader linkage 40, the loading tool 26 can be adjusted in terms of its height relative to the ground 42 and in terms of its inclination, such that it is made possible for the loading tool 26 to be plunged in targeted fashion into a stock 44 of load material in order to pick up the load material 22. The load material 22 comprises materials such as straw, hay, silage, manure, cereals, maize, gravel, sand, soil, or the like.

The arrangement 12 comprises a microprocessor-controlled control unit 46, which is connected via a CAN data bus 48 to a plurality of wheel rotational speed sensors 50, 52 that serve to provide information regarding the wheel rotational speeds arising at associated wheels 54, 56 of the agricultural tractor 16.

The control unit 46 furthermore communicates via the CAN data bus 48 with a valve arrangement 60 for controlling the first and second actuating devices 32, 34, to which valve arrangement hydraulic fluid is fed from a hydraulic system 58 of the agricultural tractor 16, and also with a user interface 64, which is in the form of a touch sensitive display 62, and with a memory unit 66.

The front loader 18 is operated using an operator control hand lever 70, which is in the form of a joystick 68 and which is also connected via the CAN data bus 48 to the control unit 46 for evaluating a sensor-detected deflection at the operator control hand lever 70, wherein the first actuating device 32 is hydraulically controlled, for the purposes of raising and lowering the front loader boom 30, by the control unit 46 in accordance with the sensor-detected deflection. Here, the operator control hand lever 70, the control unit 46, the valve arrangement 60 and the two hydraulically controllable actuating devices 32, 34 constitute the core components of the front loader control system 10.

More specifically, the front loader boom 30 can be raised and lowered in accordance with the direction of deflection of the operator control hand lever 70, wherein the extent of the deflection determines a hydraulic flow generated for the hydraulic control of the first actuating device 32, said hydraulic flow being provided via the valve arrangement 60 in accordance with a functional relationship that is adaptable by the control unit 46.

Feedback on the state of actuation of the loader linkage 40 to the control unit 46 is provided the basis of information provided by a sensor arrangement 72 for detecting the pressure conditions in the two actuating devices 32, 34 and the present position of the front loader boom 30 and loading tool 26.

As per FIG. 1, the method which is carried out by the control unit 46 and which is stored as corresponding program code in the memory unit 66 is started by the operator in a starting step 100 by calling up the corresponding assistance function via the touch sensitive display 62 of the user interface 64, whereupon, in a first main step 102, the control unit 46 determines a material property variable that represents a plunging resistance that opposes the loading tool 26 when picking up the load material 22.

The derivation of the plunging resistance, which is required to determine the material property variable, is performed here by detecting an actuation moment that is exerted on the loading tool 26 when picking up the load material 22. The actuation moment is estimated by the control unit 46 in the first main step 102 on the basis of the information, provided by the sensor arrangement 72, regarding the pressure conditions in the second actuating device 34 that is provided for tilting the loading tool 26. Alternatively, a direct detection is performed by means of a strain gauge device (not shown in FIG. 1) provided at a suitable location on the load linkage 40.

On the basis of the material property variable determined in the first main step 102, the control unit 46 thereupon assigns the picked-up load material 22 to a first material class characterized by soft material properties or to a second material class characterized by hard material properties, said assignment being subject to a multi-stage verification.

In a second main step 104, the actuation moment detected in the first main step 102 is firstly evaluated by the control unit 46, on the basis of a corresponding comparison, as regards whether said actuation moment is to be assigned to a respectively associated class-specific value range.

The method continues, in the first case, with a third main step 106, and in the second case, with a first secondary step 108, with the aim of verifying the undertaken assignment of the picked-up load material 22 to one of the two material classes. For this purpose, the control unit 46 considers the detected actuation moment in relation to a speed variable, which reflects a plunging speed of the loading tool 26 into the load material 22, and compares said detected actuation moment, in the first secondary step 108, with a further class-specific value range assigned to the first material class, or in the third main step 106, with a further class-specific value range assigned to the second material class. If an assignment to the relevant further class-specific value range is possible, then the method continues with a second secondary step 110 or a fourth main step 112. The method otherwise returns, without performing any further actions, to the start, in order to be carried out anew.

The above-described verification makes it possible for the actuation moment that is exerted on the loading tool 26 to additionally be evaluated with regard to speed-dependent influences, making an additional limitation or specification possible in the assignment of the picked-up load material 22 to one of the two material classes. The speed variable that is taken into consideration for this purpose is in this case obtained, to a good approximation, from the present forward traveling speed of the agricultural tractor 16, wherein this in turn is determined on the basis of the information, provided via the CAN data bus 48, regarding the wheel rotational speeds arising at the associated wheels 54, 56 of the agricultural tractor 16.

In a second secondary step 110 or fourth main step 112, a further verification of the undertaken assignment of the picked-up load material 22 to one of the two material classes is provided, for which purpose the control unit 46 determines the weight of the load material 22 picked up by the loading tool 26 and compares said weight, in the second secondary step 110, with a class-specific weight range assigned to the first material class, or in the fourth main step 112, with a class-specific weight range assigned to the second material class.

This makes allowance for the fact that soft and hard materials generally exhibit significant differences in terms of their mass density, which can be utilized for the purposes of further limitation or specification in the assignment of the picked-up load material 22 to one of the two material classes. The weight determination is performed on the basis of the information provided by the sensor arrangement 72 for detecting the pressure conditions in the two actuating devices 32, 34 and the present position of the front loader boom 30 and loading tool 26, for example using a weighing device as described in detail in EP 2 843 378 A1.

If an assignment to the relevant class-specific weight range is possible, then the method continues with a third secondary step 114 or a fifth main step 116, in which the functional relationship between the sensor-detected deflection at the operator control hand lever 70 and the hydraulic flow generated for the hydraulic control of the first actuating device 32 is adapted with regard to a linear or progressive or mixed linear-progressive generation of the hydraulic flow, or is if appropriate correspondingly limited for this purpose. In this case, too, the method otherwise returns, without performing any further actions, to the start, in order to be carried out anew. In this context, the generation of the hydraulic flow is linear or progressive if it increases proportionally or (quasi-) exponentially with the sensor-detected deflection of the operator control hand lever 70.

The class-specific value and weight ranges stored as an associated data set in the memory unit 66 are specified empirically, for which purpose a multiplicity of goods for transfer are correspondingly evaluated and classified in advance.

Finally, it is to be noted that the illustration of a front loader 18 designed as a removable accessory unit on an agricultural tractor 16 is merely an example, and the latter may equally be designed as a bucket excavator, a telescopic loader or some other corresponding loading vehicle from the construction or agricultural sector.

The terminology used herein is for the purpose of describing example embodiments or implementations and is not intended to be limiting of the disclosure. As used herein, the singular forms "a," "an," and "the" are intended to include the plural forms as well, unless the context clearly indicates otherwise. It will be further understood that the any use of the terms "has," "includes," "comprises," or the like, in this specification, identifies the presence of stated features, integers, steps, operations, elements, and/or components, but does not preclude the presence or addition of one or more other features, integers, steps, operations, elements, components, and/or groups thereof.

Those having ordinary skill in the art will recognize that terms such as "above," "below," "upward," "downward," "top," "bottom," etc., are used descriptively for the drawings, and do not represent limitations on the scope of the present disclosure, as defined by the appended claims. Furthermore, the teachings may be described herein in terms of functional and/or logical block components or various processing steps, which may include any number of hardware, software, and/or firmware components configured to perform the specified functions.

Terms of degree, such as "generally," "substantially," or "approximately" are understood by those having ordinary skill in the art to refer to reasonable ranges outside of a given value or orientation, for example, general tolerances or positional relationships associated with manufacturing, assembly, and use of the described embodiments or implementations.

As used herein, "e.g.," is utilized to non-exhaustively list examples and carries the same meaning as alternative illustrative phrases such as "including," "including, but not limited to," and "including without limitation." Unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

While the above describes example embodiments or implementations of the present disclosure, these descriptions should not be viewed in a restrictive or limiting sense. Rather, there are several variations and modifications which may be made without departing from the scope of the appended claims.

What is claimed is:

1. A method for adapting the operator control and actuation characteristic of a front loader control system that has an operator control hand lever, the method comprising:

evaluating via a controller a sensor-detected deflection at the operator control hand lever;

hydraulically controlling via the controller an actuating device in accordance with the sensor-detected deflection for raising and lowering a front loader boom having a loading tool for picking up a load material;

adapting via the controller a functional relationship between the sensor-detected deflection at the operator control hand lever and a hydraulic flow generated for the hydraulic control of the actuating device;

adapting via the controller the functional relationship in accordance with a determined material property variable that represents a plunging resistance opposing the loading tool when picking up the load material;

assigning via the controller, on the basis of the determined material property variable, the picked-up load material to one of a first material class characterized by soft material properties or to a second material class characterized by hard material properties, and the functional relationship is adapted on the basis of this assignment;

comparing via the controller, for the purposes of assigning the picked-up load material to one of the first or second material classes, the detected actuation moment with a respectively associated class-specific value range; and considering via the controller, for the purposes of verifying the undertaken assignment of the picked-up load material to one of the first or second material classes, the detected actuation moment in relation to a speed variable, which reflects a plunging speed of a loading tool into the load material, and comparing via the controller the detected actuation moment with a respectively associated further class-specific value range.

2. The method of claim 1, wherein the functional relationship is adapted by the controller with regard to one of a linear, progressive, or mixed linear-progressive generation of the hydraulic flow.

3. The method of claim 1, wherein, for the purposes of determining the material property variable, the controller detects an actuation moment that is exerted on the loading tool when picking up the load material.

4. The method of claim 1, wherein, for the purposes of verifying the undertaken assignment of the picked-up load material to one of the first or second material classes, the controller determines the weight of the load material picked up by the loading tool, and compares the weight with a respectively associated class-specific weight range.

5. A system for adapting the operator control and actuation characteristic of a front loader control system that has an operator control hand lever, comprising:

a controller configured to:

evaluate a sensor-detected deflection at the operator control hand lever;

hydraulically control an actuating device in accordance with the sensor-detected deflection, for raising and lowering a front loader boom having a loading tool for picking up a load material;

adapt a functional relationship between the sensor-detected deflection at the operator control hand lever and a hydraulic flow generated for the hydraulic control of the actuating device;

adapt the functional relationship in accordance with a determined material property variable that represents a plunging resistance opposing the loading tool when picking up the load material;

assign, on the basis of the determined material property variable, the picked-up load material to one of a first material class characterized by soft material properties or to a second material class characterized by hard material properties, and the functional relationship is adapted on the basis of this assignment;

compare, for the purposes of assigning the picked-up load material to one of the first or second material classes, the detected actuation moment with a respectively associated class-specific value range; and consider, for the purposes of verifying the undertaken assignment of the picked-up load material to one of the first or second material classes, the detected actuation moment in relation to a speed variable, which reflects a plunging speed of a loading tool into the load material, and compare the detected actuation moment with a respectively associated further class-specific value range.

6. The system of claim 5, wherein the controller is configured to adapt the functional relationship with regard to one of a linear, progressive, or mixed linear-progressive generation of the hydraulic flow.

7. The system of claim 5, wherein, for the purposes of determining the material property variable, the controller is configured to detect an actuation moment that is exerted on the loading tool when picking up the load material.

8. The system of claim 5, wherein, for the purposes of verifying the undertaken assignment of the picked-up load material to one of the first or second material classes, the controller is configured to determine the weight of the load material picked up by the loading tool, and compare the weight with a respectively associated class-specific weight range.

* * * * *